US005615645A

United States Patent [19]

Kanno

[11] Patent Number: 5,615,645

[45] Date of Patent: Apr. 1, 1997

[54] ENGINE CONTROL

[75] Inventor: Isao Kanno, Hamamatsu, Japan

[73] Assignee: Sanshin Kogyo Kabushiki Kaisha, Hamamatsu, Japan

[21] Appl. No.: 597,022

[22] Filed: Feb. 5, 1996

[30] Foreign Application Priority Data

Feb. 7, 1995 [JP] Japan ..... 7-019423

[51] Int. Cl.[6] ..... F02B 77/00

[52] U.S. Cl. ..... 123/73 C; 123/478; 123/198 DB

[58] Field of Search ..... 123/478, 198 DB, 123/179.9, 179.12, 179.14, 73 A, 73 B, 73 C

[56] References Cited

U.S. PATENT DOCUMENTS 4,230,066 10/1980 Lovret ..... 123/179.9
4,391,241 7/1983 Dohshita et al. ..... 123/198 DB
4,867,115 9/1989 Henein ..... 123/179.17
4,924,827 5/1990 Minegishi ..... 123/198 DB
5,074,263 12/1991 Emerson ..... 123/179.5
5,282,447 2/1994 Kubota ..... 123/198 DB

*Primary Examiner*—David A. Okonsky
*Attorney, Agent, or Firm*—Lknobbe, Martens, Olson & Bear LLP

[57] ABSTRACT

An engine control arrangement including a fuel injector and an engine stop for disabling the running for the engine. In order to facilitate restarting, the fuel injector is permitted to continue to discharge fuel for a time period after the engine stop control is initiated.

26 Claims, 2 Drawing Sheets

ENGINE CONTROL

BACKGROUND OF THE INVENTION

This invention relates to an engine control and more particularly to an arrangement and method for controlling the fuel injection system of an internal combustion engine.

In the interest of improving engine performance, fuel economy and exhaust emission control it has been proposed to employ fuel injection systems rather than carburetors. With fuel injection systems, the amount of fuel flowing to the engine can be much more accurately controlled, particularly on a cycle by cycle basis. Thus, fuel injectors are gaining preference in their utilization for engine charge forming systems.

Although fuel injectors have an advantage over carburetors in many regards, there is one area where the fuel injector does have a disadvantage relative to a carburetor. This deals with the stopping of an engine and the subsequent restarting of the engine. For a variety of reasons, there are certain advantages to supplying the fuel to the engine through its induction system rather than directly into the combustion chamber. One disadvantage with this type of arrangement is, however, when the engine is shut down. This is also the area where fuel injection systems have a disadvantage relative to carburetors.

For cost and other reasons, it has been the preferred practice to employ injection systems where the fuel is injected into the induction system rather than directly into the combustion chamber. Such induction systems are referred to as "manifold induction" systems. When the engine is provided with a manifold or induction system injection system, there is some delay before the fuel charge actually reaches the combustion chambers. If, however, a certain amount of residual fuel is permitted to remain in the induction path after engine shut down, then restarting can be facilitated without requiring excess enrichment to effect the restarting.

With a conventional, carbureted engine, the ignition system is shut off or disabled to stop the engine. The engine will, however, rotate for a number of revolutions after the ignition is stopped due to its rotational inertia. When a carburetor is provided, the air flow through the carburetor will cause additional fuel to be drawn into the induction system and even into the combustion chamber. Hence, restart up is greatly facilitated, particularly when the engine is restarted after a short time interval.

It has been the practice, however, with fuel injection systems to shut off the fuel injection at the same time the engine is disabled. This is possible with most widely used injection systems since the fuel injectors are also electrically controlled.

When a fuel injected engine is shut off, therefore, the fuel flow stops and the engine continues to rotate. This means that any residual fuel in the intake passage will be pumped out of the exhaust and will not remain in the intake passage or combustion chamber. Thus, restarting is difficult with this type of arrangement.

It is, therefore, a principal object of this invention to provide an improved engine control and method particularly adapted for facilitating the restarting of engines.

It is a further object of this invention to provide an improved engine control method for a fuel injected engine wherein restarting is facilitated.

These problems are true with all engines. However, with two cycle crankcase compression engines the problem is even more acute. This is because the induction passage is much longer and there is a greater time interval on restarting for a combustible mixture to finally reach the combustion chamber.

SUMMARY OF THE INVENTION

This invention is adapted to be embodied in an internal combustion engine control and control methodology. The engine is comprised of a combustion chamber and an induction system which delivers at least an air charge to the combustion chamber. A fuel injector is provided that is operated so as to supply fuel to the engine through its induction system. Means are provided for stopping the engine and also restarting of the engine.

In accordance with a system for practicing the invention, when the stopping procedure is initiated for the engine, fuel is continued to be supplied by the fuel injector for a time period before the engine actually stops rotating.

In accordance with a method for practicing the invention, upon the initiation of the stopping operation, fuel supply is continued from the fuel injector for a time period before the engine actually stops rotating.

DETAILED DESCRIPTION OF THE PREFERRED EMBODIMENT

Figure 1:
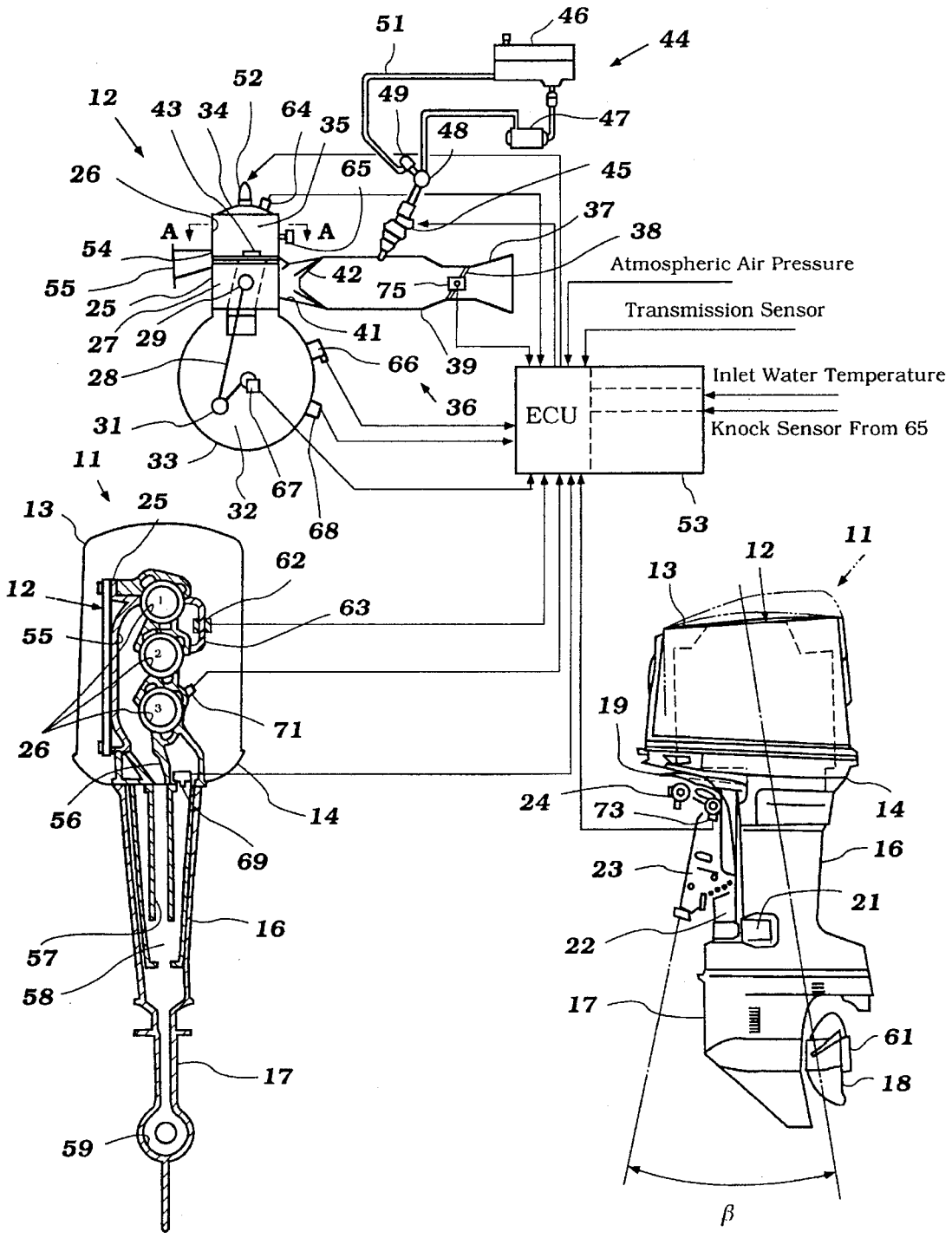
FIG. 1 is a composite view consisting of, at the bottom, right hand side, a partial side elevational view of an outboard motor constructed and operated in accordance with an embodiment of the invention. The lower, left hand view of this figure is a cross sectional view taken generally along the line A—A of the remaining view. This remaining, upper view is a partially schematic cross sectional view taken through a single cylinder of the engine showing the components associated with the control system.

Referring now in detail to the drawings and initially to FIG. 1, an outboard motor constructed in accordance with an embodiment of the invention is identified generally by the reference numeral 11. The invention is described in conjunction with an outboard motor because the invention deals with an internal combustion engine and the control system therefor. Also, outboard motors frequently employ two cycle, crankcase compression engines as their propulsion units. As will become apparent the invention has particular utility with such engines although the invention is not so limited. Therefore, an outboard motor is a typical application in which an engine constructed and operated in accordance with the invention may be utilized.

The outboard motor 11 is comprised of a power head that consists of a powering internal combustion engine, indicated generally by the reference numeral 12 and a surrounding protective cowling comprised of a main cowling portion 13 that is detachably connected to a tray portion 14.

As is typical with outboard motor practice, the engine 12 is supported within the power head so that its output shaft, a crankshaft indicated by the reference numeral 15 in the upper view of this figure, rotates about a vertically-extending axis. This output shaft or crankshaft 15 is rotatably coupled to a drive shaft (not shown) that depends into and is journaled within a drive shaft housing 16. The tray 14 encircles the upper portion of the drive shaft housing 16.

The drive shaft continues on into a lower unit 17 where it can selectively be coupled to a propeller 18 for driving the propeller 18 in selected forward or reverse direction so as to so propel an associated load, namely a watercraft. A conventional forward reverse bevel gear transmission is provided for this purpose.

A steering shaft (not shown) having a tiller 19 affixed to its upper end is affixed in a suitable manner, by means which include a lower bracket assembly 21, to the drive shaft housing 16. This steering shaft is journaled within a swivel bracket 22 for steering of the outboard motor 11 about a vertically-extending axis defined by the steering shaft.

The swivel bracket 22 is, in turn, connected to a clamping bracket 23 by means of a trim pin 24. This pivotal connection permits tilt and trim motion of the outboard motor 11 relative to the associated transom of the powered water craft. The trim adjustment through the angle β permits adjustment of the angle of the attack of the propeller 18 to obtain optimum propulsion efficiency. In addition, beyond the range defined by the angle β, the outboard motor 11 may be tilted up to and out of the water position for trailering and other purposes, as is well known in this art.

The construction of the outboard motor 11 as thus far described may be considered to be conventional and for that reason, further details of this construction are not illustrated nor are they believed necessary to permit those skilled in the art to practice the invention.

Continuing to refer to FIG. 1 but now referring primarily the lower left hand portion of this figure and the upper portion, the engine 12 is, in the illustrated embodiment, of the three-cylinder in-line, two cycle type. To this end, the engine 12 is provided with a cylinder block 25 in which three horizontally extending, vertically aligned, parallel cylinder bores 26 are formed. Although the invention is described in conjunction with a three-cylinder in-line engine, it will be readily apparent to those skilled in the art how the invention may be utilized with engines having various cylinder numbers and cylinder configurations. In addition, the invention may also be employed with four stroke engines.

Pistons shown schematically at 27 in FIG. 1 are connected to connecting rods 28 by means of piston pins 29. The lower or big ends of the connecting rods 28 are journaled on respective throws 31 of the output shaft or crankshaft 15, as is well known in this art.

The crankshaft 15 is rotatably journaled within a crankcase chamber 32 formed at the lower ends of the cylinder bores 26. The crankcase chambers 32 are formed by the skirt of the cylinder block 25 and a crankcase member 33 that is affixed to the cylinder block 25 in any well known manner. As has been noted, the engine 12 operates on a two-cycle crankcase compression principal. As is typical with such engines, the crankcase chambers 32 associated with each of the cylinder bores 26 are sealed relative to each other in any suitable manner.

The ends of the cylinder bores 26 opposite the crankcase chambers 32 are closed by means of a cylinder head assembly 34 that is affixed to the cylinder block 25 in any known manner. The cylinder head 34 has recesses which cooperate with the cylinder bores 26 and the heads of the pistons 27 to form combustion chambers, indicated generally by the reference numeral 35. These combustion chambers 35 have a volume which varies cyclically during the reciprocation of the pistons 27 as is well known in this art.

An intake charge is delivered to the crankcase chambers 32 for compression therein by means of a charge forming and induction system, indicated generally by the reference numeral 36. The charge forming and induction system 36 includes an air inlet device 37 that is disposed within the protective cowling of the power head and which draws air therefrom. This air is admitted to the interior of the protective cowling by one or more air inlets formed primarily in the main cowling member 13.

A throttle valve 38 is positioned in the induction passage or intake manifold 39 that connects the air inlet device 37 to respective intake ports 41 formed in the cylinder block 25 and which communicate with the crankcase chambers 32 in a well known manner.

Reed type check valves 42 are provided in each of the intake ports 41 so as to permit a charge to flow into the crankcase chambers 32 when the pistons 27 are moving upwardly in the cylinder bores 26. On the other hand, when the pistons 27 move downwardly these valves 42 close and the charge is compressed in the crankcase chambers 32. The compressed charge is transferred to the combustion chambers 35 through one or more scavenge passages 43.

Fuel is supplied to the air charge admitted as thus far described by a charge forming system, indicated generally by the reference numeral 44. This charge forming system 44 includes one or more fuel injectors 45 that spray into each of the intake passages 39. The fuel injectors 45 are of the electrically operated type having electrically actuated solenoid injector valves (not shown) that control the admission or spraying of fuel into the intake passages 39 upstream of the check valves 42.

Fuel is supplied to the fuel injectors from a remotely positioned fuel tank 46. The fuel tank 46 is, most normally, positioned within the hull of the associated watercraft as is well known in this art. The fuel is drawn through a supply conduit by a pumping system including an electrically driven high pressure pump 47 which discharges into a main fuel rail 48. The fuel rail 48 supplies fuel to each of the fuel injectors 45 in a known manner.

A pressure control valve 49 is provided in or adjacent the fuel rail 48 and controls the maximum pressure in the fuel rail 48 by dumping excess fuel back to the fuel tank 46 or some other place in the system upstream of the fuel rail 48 through a return conduit 51. The fuel that is mixed with the air in the induction and charge forming system 36 as thus far described will be mixed and delivered to the combustion chambers 35 through the same path already described.

Spark plugs 52 are mounted in the cylinder head 34 and have their gaps extending into the respective combustion chambers 35. These spark plugs 52 are fired by ignition coils that are actuated by an ignition circuit that is controlled by a control means which includes an electronic control unit or ECU 53 which will be discussed in detail later.

When the spark plugs 52 fire, the charge in the combustion chambers 35 will ignite, burn and expand. This expanding charge drives the pistons 27 downwardly to drive the crankshaft 15 in a well known manner. The exhaust gases are then discharged through one or more exhaust ports 54 which open through the sides of the cylinder block bores 26 and communicate with an exhaust manifold 55 as shown schematically in the upper view of FIG. 1 and in more detail in the lower left side view of this figure.

Referring now primarily to the lower left hand side view of FIG. 1, the exhaust manifold 55 terminates in a downwardly facing exhaust discharge passage 56 that is formed in an exhaust guide plate upon which the engine 12 is mounted. This exhaust guide plate delivers gases to an exhaust pipe 57 that depends into the drive shaft housing 16.

The drive shaft housing 16 defines an expansion chamber 58 in which the exhaust pipe 57 terminates. From the expansion chamber 58, the exhaust gases are discharged to the atmosphere in any suitable manner such as by means of a underwater exhaust gas discharge 59 which discharges through the hub 61 of the propeller 18 in a manner well known in this art. At lower speeds when the propeller 18 is more deeply submerged, the exhaust gases may exit through and above the water atmospheric exhaust gas discharge (not shown) as also is well known in this art.

In addition to controlling the timing of the firing of the spark plugs 52, the ECU 53 also controls the timing and duration of fuel injection of the fuel injector 45 and may control other engine functions. For this purpose, there are provided a number of engine and ambient condition sensors. In addition, there is provided a feedback control system through which the ECU 53 controls the fuel air ratio in response to the measurement of the actual fuel air ratio by a combustion condition sensor such as an oxygen ($O_2$) sensor 62 which is positioned in a passageway 63 that interconnects two of the cylinder bores 26 at a point adjacent the point where the exhaust passages 54 are located.

In addition to the 02 sensor, other sensors of engine and ambient conditions are provided. These include an in-cylinder pressure sensor 64 and knock sensor 65 that are mounted in the cylinder head 34 and cylinder block 25, respectively. The outputs from these sensors are transmitted to the ECU 53.

Air flow to the engine may be measured in any of a variety of fashions and this may be done by sensing the pressure in the crankcase chamber 32 by means of a pressure sensor 66. As is known, actual intake air flow can be accurately measured by the measuring the pressure in the crankcase chamber 32 at a specific crank angle. A crank angle position sensor 67 is, therefore, associated with the crankshaft 15 so as to output a signal to the ECU 53 that can be utilized to calculate intake air flow and, accordingly, the necessary fuel amount so as to maintain the desired fuel air ratio. The crank angle sensor 67 may be also used as a means for measuring engine speed, as is well known in this art.

Intake air temperature is measured by a crankcase temperature sensor 68 which is also positioned in the crankcase 33 and senses the temperature in the crankcase chambers 32.

Exhaust gas back pressure is measured by a back pressure sensor 69 that is mounted in a position to sense the pressure in the expansion chamber 58 within the drive shaft housing 16.

Engine temperature is sensed by an engine temperature sensor 71 that is mounted in the cylinder block 25 and which extends into its cooling jacket. In this regard, it should be noted that the engine 12 is, as is typical with outboard motor practice, cooled by drawing water from the body of the water in which the outboard motor 11 operates. This water is circulated through the engine 12 and specifically its cooling jackets and then is returned to the body of water in any suitable return fashion.

The temperature of the intake water drawn into the engine cooling jacket is also sensed by a temperature sensor which is not illustrated but which is indicated by an arrow and legend in FIG. 1. In addition other ambient conditions such as atmospheric air pressure are transmitted to the ECU 53 by appropriate sensors and as indicated by the arrows in FIG. 1.

A trim angle sensor 73 is provided adjacent the trim pin 24 so as to provide a signal indicative of the angle β.

A throttle angle position sensor 75 is also provided and outputs a signal indicative of the position of the throttle valve 38 to the ECU 53.

The engine 12 is also provided with an electrical starter (not shown) that cooperates with the flywheel of a flywheel magneto driven off the upper end of the crankshaft 15. This starter is operated by a remote starter switch as is well known in the art.

Figure 2:
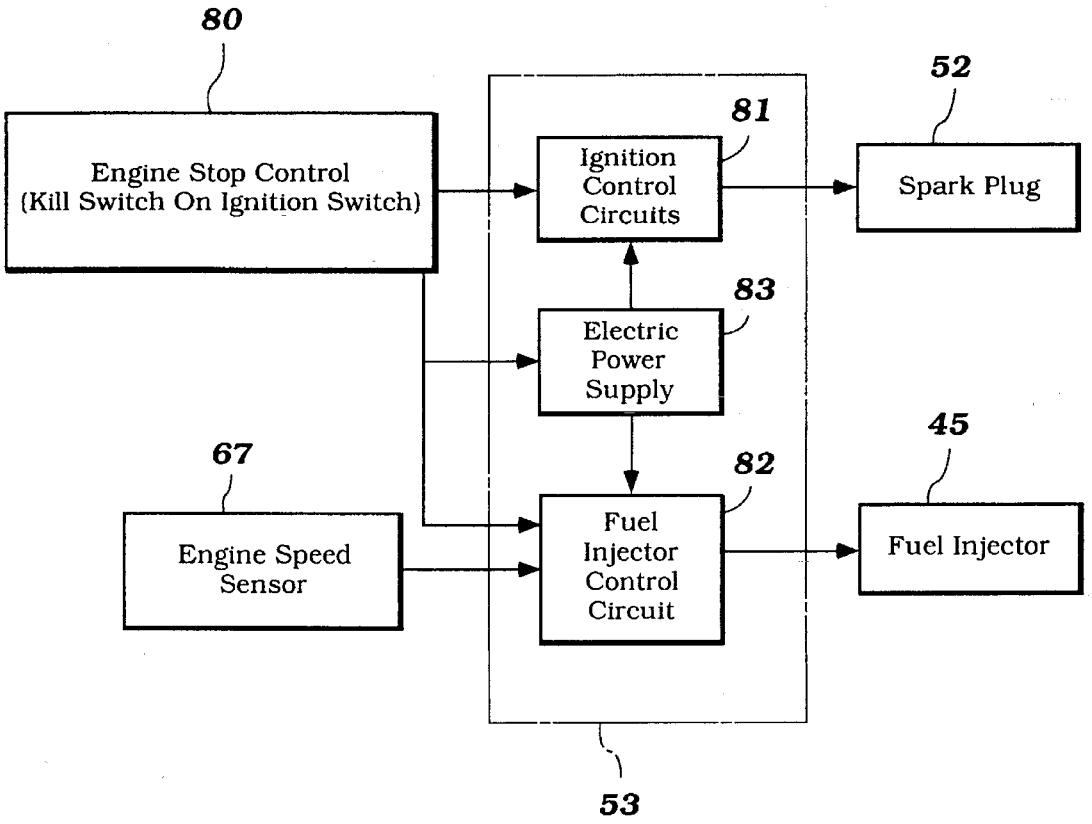
FIG. 2 is a schematic block diagram showing the association of the various components of the control system.

In order to stop the engine from running, a suitable kill switch or other apparatus indicated schematically at 80 in FIG. 2 is provided for disabling the ignition and preventing the filing of the spark plug 52. Again, this type of arrangement is well known in the art and, therefore, further description of it is not believed to be necessary to permit those skilled in the art to practice the invention.

The control routine and methodology whereby the ECU 53 controls the timing of injection of fuel from the fuel injector 45 and the duration of fuel injection of the injector 45 and the timing of firing of the spark plug 52 can be of any known type. Although the system is illustrated as being of the feedback control type using the output from the oxygen sensor 62, it should be readily apparent that various control strategies may be employed which do not utilize feedback control and/or combustion condition sensors. Since the basic operation of the operational control forms no part of the invention, it also will not be described in the detail.

As should be readily apparent from the foregoing description, the invention deals primarily with the shut down method for the engine which method facilitates restarting. This methodology may be understood best by reference to FIG. 2 which shows the interrelationship between the various components. Not all of the inputs to the ECU 53 are shown and only the ignition switch or engine kill switch 80_and the output from the crank angle sensor 67_, which provides an engine speed signal, are shown as having their inputs going to the ECU 53. The ECU 53, as has been noted, controls the firing of the spark plugs 52 and the fuel injectors 45 and these control lines are shown schematically in this figure.

The spark plugs 52 are controlled by an ignition control circuit, indicated schematically at 81, while the fuel injectors are controlled by a fuel injection circuit, indicated schematically at 82. FIG. 2 only shows the inter-connections necessary to operate the shut down principal and thus delete the connections necessary for the full control of the spark plug 52 and the fuel injector 45. The way these components are interrelated also forms no part of the invention and any known or conventional type of system may be employed for this control.

However, the system provides a control of an electrical power supply 83 which outputs electrical power to both the ignition control circuits 81 and also the fuel injector control circuit 82. The connection to the ignition control circuit 81 may be deleted and the engine stop control 80 may directly shut off the ignition control circuit 81 upon stopping so as to stop the firing of the spark plugs 52.

In accordance with the control methodology, when the engine stop control 80 is activated, the ignition control circuit is 81 is immediately disabled and the firing of the spark plugs 52 will be stopped. Also, the electric power supply circuit 83 is shut off, but it includes a time delay shut off for the circuit that controls and supplies electrical energy to the fuel injector control circuit 82.

The engine speed sensor 67 will continue to output a signal to the fuel injector control circuit 82. After the stopping of firing of spark plugs 52, the rotation of the crankshaft 15 will not immediately discontinue and the reciprocation of the pistons 27 will also continue while the inertia of the engine 12 dissipates.

During a time period which may be either a predetermined time or a continuing time until the engine speed sensor 67 outputs no signal, the fuel injector control circuit 82, under the supply of continued electric power from the electric power supply 83 due to the time delay, will output pulse signals to the fuel injectors 45 so as to continue injecting fuel. The injection may be done either per crankshaft revolution or on any desired sequence to supply an amount of fuel which is believed to be desirable for facilitating restarting.

This fuel injection may continue until the crankshaft 15 stops rotation or for a finite time period after shut down. Only then will the fuel injector control circuit 82 be disabled from the electric power supply 83 and will discontinue the supply of actuating pulses to the fuel injector 45.

Therefore, fuel will be injected into the induction system 39 and also pass into the crankcase chamber 32 and scavenge passage 43. Thus, upon restarting there will not be any time delay before a combustible mixture reaches the combustion chambers 35 and quicker restarting as possible.

It should readily apparent, therefore, that the aforedescribed invention is particularly useful in facilitating the restarting of engines and particularly fuel injected engines and specifically, but not limited to, those operating on the two cycle crankcase compression principle.

It will be understood that the foregoing description is that of a preferred embodiment of the invention and that various changes and modifications may be made without departing from the spirit and scope of the invention, as defined the appended claims.

What is claimed is:

1. An internal combustion engine and control therefor, said engine comprising a combustion chamber, an induction system for delivering a charge to said combustion chamber, a fuel injector for injecting fuel into said induction system, an engine starting device for starting said engine, an engine stopping device for stopping the running of said engine, and means for continuing the injection of fuel from said fuel injector into said induction system after the initiation of engine stopping by said engine stopping device and for a time period before the engine actually stops its operation.

2. An internal combustion engine of claim 1, wherein the engine includes a spark plug having a gap in the combustion chamber for initiating combustion therein and an ignition control circuit for firing said spark plug, the engine stopping device being effective to disable the ignition control circuit for discontinuing the firing of the spark plug.

3. An internal combustion engine of claim 2, wherein the fuel injection is continued until the engine totally stops running after the stopping device is initiated.

4. An internal combustion engine of claim 1, wherein the fuel injector is electrically operated and wherein the engine stopping device discontinues the supply of electrical power to certain components of the engine necessary for its operation and means for preventing the discontinuance of the supply of electrical power to the fuel injector until after the predetermined time period.

5. An internal combustion engine of claim 4, wherein the fuel injection is continued until the engine totally stops running after the stopping device is actuated.

6. An internal combustion engine of claim 5, wherein the engine includes a spark plug having a gap in the combustion chamber for initiating combustion therein and an ignition control circuit for firing said spark plug, the engine stopping device being effective to disable the ignition control circuit for discontinuing the firing of the spark plug.

7. An internal combustion engine of claim 1 wherein the engine is a two cycle, crankcase compression, engine.

8. An internal combustion engine of claim 7 wherein the induction system delivers its charge to a crankcase chamber of the engine.

9. An internal combustion engine of claim 8, wherein the engine includes a spark plug having a gap in the combustion chamber for initiating combustion therein and an ignition control circuit for firing said spark plug, the engine stopping device being effective to disable the ignition control circuit for discontinuing the firing of the spark plug.

10. An internal combustion engine of claim 9, wherein the fuel injection is continued until the engine totally stops running after the stopping device is initiated.

11. An internal combustion engine of claim 8, wherein the fuel injector is electrically operated and wherein the engine stopping device discontinues the supply of electrical power to certain components of the engine necessary for its operation and means for preventing the discontinuance of the supply of electrical power to the fuel injector until after the predetermined time period.

12. An internal combustion engine of claim 11, wherein the fuel injection is continued until the engine totally stops running after the stopping device is actuated.

13. An internal combustion engine of claim 12 wherein the engine includes a spark plug having a gap in the combustion chamber for initiating combustion therein and an ignition control circuit for firing said spark plug, the engine stopping device being effective to disable the ignition control circuit for discontinuing the firing of the spark plug.

14. A method of operating an internal combustion engine having a combustion chamber, an induction system for delivering a charge to said combustion chamber, a fuel injector for injecting fuel into said induction system, an engine starting device for starting said engine, an engine stopping device for stopping the running of said engine, said method comprising the step of continuing the injection of fuel from said fuel injector into said induction system after the initiation of engine stopping and for a time period before the engine actually stops its operation.

15. A method of operating an internal combustion engine of claim 14 wherein the engine includes a spark plug having a gap in the combustion chamber for initiating combustion therein, and an ignition control circuit for firing the spark plug, the ignition control circuit being disabled upon engine stopping for discontinuing the firing of the spark plugs.

16. A method of operating an internal combustion engine of claim 15, wherein the fuel injection is continued until the engine totally stops running after the stopping device is initiated.

17. A method of operating an internal combustion engine of claim 14, wherein the fuel injector is electrically operated and wherein the engine stopping device discontinues the supply of electrical power to certain components of the engine necessary for its operation and means for preventing the discontinuance of the supply of electrical power to the fuel injector until after the predetermined time period.

18. A method of operating an internal combustion engine of claim 17, wherein the fuel injection is continued until the engine totally stops running after the stopping device is actuated.

19. A method of operating an internal combustion engine of claim 18, wherein the engine includes a spark plug having a gap in the combustion chamber for initiating combustion therein and an ignition control circuit for firing said spark plug, the engine stopping device being effective to disable the ignition control circuit for discontinuing the firing of the spark plug.

20. A method of operating an internal combustion engine of claim 14 wherein the engine is a two cycle, crankcase compression, engine.

21. A method of operating an internal combustion engine of claim 20 wherein the induction system delivers its charge to a crankcase chamber of the engine.

22. A method of operating an internal combustion engine of claim 21, wherein the engine includes a spark plug having a gap in the combustion chamber for initiating combustion therein and an ignition control circuit for firing said spark plug, the engine stopping device being effective to disable the ignition control circuit for discontinuing the firing of the spark plug.

23. A method of operating an internal combustion engine of claim 22, wherein the fuel injection is continued until the engine totally stops running after the stopping device is initiated.

24. A method of operating an internal combustion engine of claim 23, wherein the fuel injector is electrically operated and wherein the engine stopping device discontinues the supply of electrical power to certain components of the engine necessary for its operation and the discontinuance of the supply of electrical power to the fuel injector is not initiated until after the predetermined time period.

25. A method of operating an internal combustion engine of claim 24, wherein the fuel injection is continued until the engine totally stops running after the stopping device is actuated.

26. An internal combustion engine of claim 25 wherein the engine includes a spark plug having a gap in the combustion chamber for initiating combustion therein and an ignition control circuit for firing said spark plug, the engine stopping device being effective to disable the ignition control circuit for discontinuing the firing of the spark plug.

* * * * *